US011491367B2

(12) United States Patent
Emeruwa et al.

(10) Patent No.: US 11,491,367 B2
(45) Date of Patent: Nov. 8, 2022

(54) MULTIFUNCTIONAL LEG STRENGTHENING DEVICE

(71) Applicant: Strengthen Your Legs Never Too Late, LLC, Laurel, MD (US)

(72) Inventors: Hilda Emeruwa, Laurel, MD (US); Mark Creppy, Laurel, MD (US)

( * ) Notice: Subject to any disclaimer, the term of this patent is extended or adjusted under 35 U.S.C. 154(b) by 138 days.

(21) Appl. No.: 17/126,954

(22) Filed: Dec. 18, 2020

(65) Prior Publication Data

US 2022/0105386 A1 Apr. 7, 2022

Related U.S. Application Data

(60) Provisional application No. 63/087,407, filed on Oct. 5, 2020.

(51) Int. Cl.
*A63B 23/04* (2006.01)
*A63B 21/055* (2006.01)
(Continued)

(52) U.S. Cl.
CPC ..... *A63B 23/04* (2013.01); *A63B 21/00185* (2013.01); *A63B 21/0555* (2013.01);
(Continued)

(58) Field of Classification Search
CPC ..... A63B 15/00; A63B 21/0004; A63B 21/00043; A63B 21/00185; A63B 21/002; A63B 21/0023; A63B 21/02; A63B 21/04; A63B 21/0407; A63B 21/0414; A63B 21/0421; A63B 21/0428; A63B 21/0435; A63B 21/0442; A63B 21/055; A63B 21/0552; A63B 21/0555; A63B 21/0557; A63B 21/4023; A63B 21/4033; A63B 21/4034; A63B 21/4035; A63B 21/4043; A63B 23/035; A63B 23/03508;
(Continued)

(56) References Cited

U.S. PATENT DOCUMENTS 2,935,321 A * 5/1960 Lhotka ..... A63B 15/00 D21/725
2,944,817 A * 7/1960 Stiller ..... A63B 69/0088 473/424
(Continued)

FOREIGN PATENT DOCUMENTS

WO WO-9303798 A1 * 3/1993 ..... A63B 15/005

*Primary Examiner* — Gary D Urbiel Goldner
(74) *Attorney, Agent, or Firm* — Brennan, Manna & Diamond, LLC

(57) ABSTRACT

This present invention relates to a multifunctional leg strengthening device for users to strengthen the lower extremities. The multifunctional leg strengthening device includes a resistance band that is removably attached to an exercise ball, such that the resistance band can be easily held by the user's hand while holding the exercise ball between the calves or thighs for performing leg strengthening exercises. The innovative multifunctional leg strengthening device may comprise a rigid or flexible resistance band. Also, the band may feature a pocket to accommodate the rigid stick or rod inside the pocket. The rigid stick design helps accommodate those with decreased lower body strength, thereby ensuring the muscles can be strengthened and rehabilitated.

8 Claims, 3 Drawing Sheets

(51) Int. Cl.
*A63B 21/00* (2006.01)
*A63B 43/00* (2006.01)

(52) U.S. Cl.
CPC ..... *A63B 21/0557* (2013.01); *A63B 21/4035* (2015.10); *A63B 43/007* (2013.01); *A63B 2209/00* (2013.01)

(58) Field of Classification Search
CPC ..... A63B 23/03516; A63B 23/0355; A63B 23/03575; A63B 23/04; A63B 23/12; A63B 43/00; A63B 43/007; A63B 69/0073; A63B 69/0079; A63B 69/0086; A63B 69/0088; A63B 71/0054; A63B 2071/0063; A63B 2071/0072; A63B 2209/00
See application file for complete search history.

(56) References Cited

U.S. PATENT DOCUMENTS 4,071,239 A * 1/1978 Ferguson ..... A63B 67/20 473/425
4,565,367 A * 1/1986 Kaiser ..... A63B 21/0552 482/121
4,846,472 A * 7/1989 Terza ..... A63B 69/0002 473/424
5,165,682 A * 11/1992 McGuckin ..... A63B 69/0088 473/424
5,433,435 A * 7/1995 Bourie ..... A63B 69/0079 473/576
5,615,879 A * 4/1997 Bailey ..... A63B 69/0088 473/424
6,062,993 A * 5/2000 Rodriguez ..... A63B 67/20 473/424
6,352,484 B1 * 3/2002 Killion ..... A63B 43/005 473/424
8,172,696 B2 * 5/2012 Lum ..... A63B 69/3623 473/409
8,574,102 B1 * 11/2013 Russell ..... A63B 43/007 473/425
10,765,904 B1 * 9/2020 Pasterino ..... A63B 21/4013
10,888,729 B2 * 1/2021 Haines ..... A63B 21/4043
2009/0011869 A1 * 1/2009 Bozof ..... A63B 69/0088 473/424
2010/0075784 A1 * 3/2010 Maina ..... A63B 69/0088 473/576
2010/0130313 A1 * 5/2010 Bastian ..... A63B 15/00 473/457
2011/0124441 A1 * 5/2011 Fang ..... A63B 67/06 473/417
2013/0072326 A1 * 3/2013 Pugliese ..... A63B 69/0079 473/425
2014/0287852 A1 * 9/2014 Clark ..... A63B 60/10 473/424
2014/0309081 A1 * 10/2014 Gavigan ..... A63B 15/02 482/84
2017/0035641 A1 * 2/2017 Feger ..... A61B 5/112
2017/0296898 A1 * 10/2017 Brosseau, Jr. ..... A63B 69/3661
2019/0083872 A1 * 3/2019 Dunford ..... A63B 1/00
2019/0116759 A1 * 4/2019 Petitt ..... A63B 37/06
2019/0262686 A1 * 8/2019 McCaleb ..... A63B 69/0091
2020/0289867 A1 * 9/2020 Pasterino ..... A63B 21/0607
2021/0197031 A1 * 7/2021 Cho ..... A63B 69/0086

* cited by examiner

MULTIFUNCTIONAL LEG STRENGTHENING DEVICE

CROSS-REFERENCE TO RELATED APPLICATION

The present application claims priority to, and the benefit of, U.S. Provisional Application No. 63/087,407, which was filed on Oct. 5, 2020 and is incorporated herein by reference in its entirety.

FIELD OF THE INVENTION

The present invention relates generally to the field of exercise equipment. More specifically, the present invention relates to a multifunctional leg strengthening device that enables a user to strengthen and/or exercise his or her extremities. The multifunctional leg strengthening device is comprised of a modified resistance band attached to an exercise ball, and can be used with a flexible or rigid version of the band/bar. The multifunctional leg strengthening device enables users to perform lower body exercises with the band and the ball, and without worrying about dropping or otherwise losing the ball. Accordingly, the present disclosure makes specific reference thereto. Nonetheless, it is to be appreciated that aspects of the present invention are also equally applicable to other like applications, devices, and methods of manufacture.

BACKGROUND OF THE INVENTION

By way of background, people around the world are concerned about their health and fitness on a continuous basis, and exercise and dieting is a part of most people's daily routine. As part of that routine, many people use various types of exercising devices and equipment to strengthen different body parts. These exercise devices serve many purposes including, without limitation, enabling a user to increase strength, endurance and balance, burn calories, increase muscle mass, improve agility and coordination, and increase overall performance in a sport or other task.

Equipment such as resistance bands and exercise balls are oftentimes utilized by a user to improve the overall personal fitness of his or her upper and lower body. Unfortunately, while using an exercise ball, the user may lose his or her balance and drop the exercise ball, thereby potentially causing injuries to the user or interrupting the exercise routine by the user having to stop to retrieve the exercise ball. Additionally, the user may lose interest in exercising by being forced to constantly keep the ball under control to exercise efficiently, and the struggle to keep balance of the exercise ball distracts the user from the actual exercise.

Many individuals also utilize resistance bands or cables to exercise. By way of background, a resistance band is an elastic band used for strength training and oftentimes replaces the use of free weights. Such resistance bands are also commonly used as part of an individual's physical therapy to allow for the slow rebuilding of the individual's strength without the perils associated with using free weights. More specifically, resistance band exercises help strengthen and tone the user's muscles at the same time. Unfortunately, resistance bands also suffer from a number of limitations. For example, a resistance band, when stressed, may snap, thereby causing an eye injury or other injury to the user, or other sudden movement that causes strain to the user's body. Resistance bands also make it more difficult for a user to track his or her progress over time.

Further, many daily activities, such as walking, going up and down steps, squatting, bending over, and carrying heavy loads, all require the use of multiple muscles in the lower body to work together to perform these essential tasks. When an individual's leg muscles are weak, or not performing at their best, these daily activities may be too laborious for the user to perform. Therefore, it is very important for an individual to maintain strength in the muscles of the lower body. Likewise, it is also important for an individual to build and maintain strength in the upper body, although different exercise equipment is typically required to do so. Unfortunately, when an individual is travelling, the user may not be able to transport or carry multiple different pieces of exercise equipment to exercise both the upper and lower body, and may not be able to properly exercise without the same.

Therefore, there exists a long felt need in the art for a multifunctional leg strengthening device that enables a user to strengthen his or her legs, as well as other portions of the body. There is also a long felt need in the art for a combination exercise device that offers a user the benefits of both an exercise ball and a resistance band, albeit without the expense of having to purchase two separate devices and then store the same when not in use. Moreover, there is a long felt need in the art for an exercise device that reduces the likelihood of the user dropping, and then having to interrupt an exercise routine to retrieve, the exercise ball. Additionally, there is a long felt need in the art for an exercise band that is less likely to snap and cause injury to the user or someone located nearby. Finally, there is a long felt need in the art for a combination exercise device that is relatively inexpensive to manufacture, and that is both safe and easy to use.

The subject matter disclosed and claimed herein, in one embodiment thereof, is a multifunctional leg strengthening device comprised of an improved flexible resistance band having two opposing ends, and an exercise ball. More specifically, the exercise ball is removably attached to one of the two ends of the flexible resistance band via a carabineer clip or other suitable attachment means. The exercise ball is further wrapped with a flex band in such a manner that the exercise ball can be removed from the flex band if the user so desires. To use the device, the user grasps the resistance band from the first end and performs lower body exercises with the flexible resistance band and the exercise ball, and without the fear of dropping the exercise ball. Additionally, as the flexible resistance band is stretched and elongated by the user with the exercise ball placed between the user's legs, the band provides increased resistance and strengthens the core and legs of the user. As more fully described below, alternative embodiments of the present invention may replace the resistance band with a rigid member, or with a resistance band having a pocket containing a rigid member.

In this manner, the novel multifunctional leg strengthening device of the present invention accomplishes all of the forgoing objectives, and provides a relatively safe, easy, effective and convenient solution to the need to perform exercises to strengthen a user's lower extremities, and other portions of the body. The multifunctional leg strengthening device of the present invention is also user friendly, inasmuch as it is safe, compact and relatively lightweight, and can be easily transported while travelling.

SUMMARY OF THE INVENTION

The following presents a simplified summary in order to provide a basic understanding of some aspects of the disclosed innovation. This summary is not an extensive over-view, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a multifunctional exercise equipment system having an improved flexible resistance band with two opposing ends and an exercise ball, wherein the exercise ball is removably attached to a second end of the flexible resistance band via a carabineer clip. The exercise ball is also removably wrapped in a flexible band, such that the exercise ball can be removed from the flex band if the user so desires. To use the exercise system, the user grasps the resistance band along the first end and places the exercise ball attached to the second end of the resistance band between the user's legs to perform various exercises without worry about losing control or possession of the exercise ball. More specifically, as the flexible resistance band is stretched and elongated by the user, the resistance band provides increasing resistance and strengthens the core and legs of the user.

The subject matter disclosed and claimed herein, in an alternative embodiment thereof, comprises a multifunctional leg strengthening device having an exercise ball and an elastic resistance band with two opposing ends, wherein the resistance band is extendable between a first relaxed position and a second extended and tensioned position. The elastic resistance band is further comprised of a pocket at a first end through which a straight rigid pole may be placed along the length of the band in an effort to further stiffen the band. The exercise ball is removably attached to the second end of the elastic resistance band using a fastening mechanism, such as a carabineer clip. Additionally, the first end of the elastic resistance band has a grip to enable the user to securely grasp the band, and perform various different exercise routines with the device. In various embodiments thereof, the first end of the elastic resistance band may have handles, handgrips, band grips, gloves or mitts, hand or finger loops to enable the user to better grasp the band.

In a further embodiment of the present invention, a method of performing exercises for strengthening and rehabilitating muscles in the lower body, or elsewhere, is disclosed. The method comprises the steps of initially providing an exercise device having a flexible tubular resistance band with two opposite ends. A first end has a grip for grasping the resistance band, and a second end has a fastening mechanism, such as a carabineer clip, to removably attach an exercise ball thereto. Next, a user positions himself or herself in a supine position on the top of a mat, and the first end of the resistance band is grasped over the torso while the exercise ball is held between the user's thighs, calves, or ankles with the user's shoulders and legs on the mat at a rest position. Alternatively, the user may be in a seated position, such as on a chair, bed, couch or the like. Then, the user will stretch and/or move his or her legs at different obtuse angles to the mat to move the exercise ball and work against the tension of the resistance band to provide strength to the lower body. Alternatively, if in the seated position, the user may kick the ball in a forward, backward or sideways direction relative to the user. In one embodiment, the flexible tubular resistance band may have a pocket at the first end to receive a rigid stick or rod to further stiffen the band. The pocket may run substantially the length of the band, as measured from the first end to the second opposing end. Alternatively, the exercise ball may be attached to a rigid stick or rod for horizontal and angular movements of the legs.

In a further embodiment of the present invention, an exercise device to strengthen the lower extremities of a user is disclosed. The exercise device comprises a modified resistance band in the form of a rigid stick or rod having two opposite ends. The first end of the band has a grip section for a user to grip the band, and the second end has a clip to attach the band to an exercise ball. The exercise ball can be of any suitable shape, and is preferably spherical and made up of an anti-skid or anti-slip material. The device may further comprise a length adjustment mechanism to change the length of the rigid band during the movement of the legs of the user.

In a further embodiment of the present invention, a portable free-motion multifunctional leg strengthening system is described. The system comprises one or more flexible resistance bands, with each resistance band being generally tubular in shape and having two opposing ends. A first end of each resistance band is further comprised of an attachment, such as a hook, for attaching to the outfit or belt of an user, and the second end of each resistive band is comprised of a carabineer clip to detachably attach the resistance band to an exercise ball. The resistance bands may be of different sizes, lengths, tensions and weights.

The multifunctional leg strengthening device of the present invention is particularly advantageous as a user can securely grasp the resistance band, and utilize the exercise ball without being concerned about dropping the ball which will interrupt the exercise routine. The device also offers a more convenient method of strengthening and rehabilitating muscles in the lower body and elsewhere, and features a plurality of different possible configurations in which the resistance band can be structured. Moreover, the strength and resistance of the bands can be changed, and the band is easily adjustable and flexible. The resistance band and the exercise ball can also be used separately or with other exercise equipment, such as a kettlebell attached to the resistance band by a hook, carabineer clip, or other suitable attachment means.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
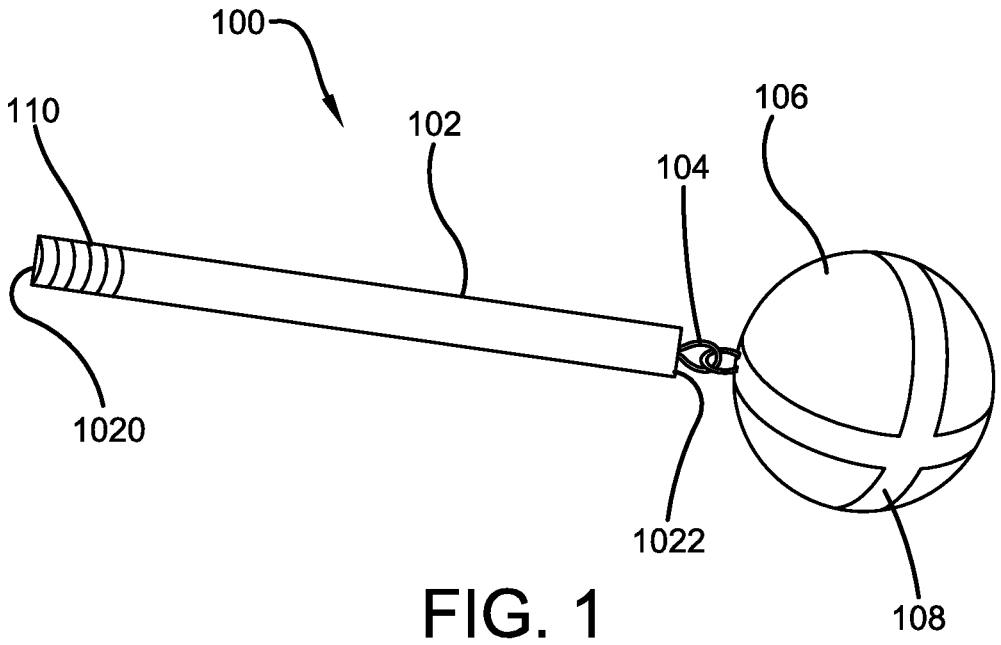
FIG. 1 illustrates a perspective view of one potential embodiment of the multifunctional leg strengthening device of the present invention in accordance with the disclosed architecture and having a rigid bar.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for a multifunctional leg strengthening device that enables a user to strengthen his or her legs (as well as other portions of the body), and that offers the user the benefits of both an exercise ball and a resistance band, albeit without the expense of having to purchase two separate exercising devices and then store the same when not in use. Moreover, there is a long felt need in the art for an exercise device that reduces the likelihood of the user dropping, and then having to interrupt an exercise routine to retrieve, the exercise ball, and for an exercise band that is less likely to snap and cause injury to the user or someone located nearby. Finally, there is a long felt need in the art for a combination exercise device that is relatively inexpensive to manufacture, and that is both safe and easy to use.

The present invention, in one exemplary embodiment, is a multifunctional exercise system having an improved flexible resistance band with two ends, and an exercise ball. The exercise ball is removably attached to a second end of the flexible resistance band via a carabineer clip, or other suitable means. The exercise ball is wrapped in a flex band, but the exercise ball can be removed from the flex band if the user so chooses. In use, a user grasps the resistance band from the first end and performs lower body exercises with the combination device without being concerned about dropping the exercise ball and interrupting the exercise routine.

Referring initially to the drawings, FIG. 1 illustrates a perspective view of one potential embodiment of the multifunctional leg strengthening device 100 of the present invention in accordance with the disclosed architecture and having a rigid bar 102. More specifically, the multifunctional leg strengthening device 100 is comprised of a rigid bar 102 and an exercise ball 106. The rigid bar 102 is comprised of a first end 1020 having a grip section 110, which is grasped by a user during, for example, an exercise routine, and a second end 1022. The second end 1022 of the rigid bar 102 may be attached to a fastening mechanism 104, such as a carabineer clip, which is used to detachably connect the exercise ball 106 to the rigid bar 102.

In a preferred embodiment, the exercise ball 106 is wrapped with a flex band 108, and is removably attached to the second end 1022 of the rigid bar 102. Further, the rigid bar 102 may further comprise stretchable handles (not shown) at the first end 1020. The rigid bar 102 design helps to accommodate elderly people and those with decreased lower body strength, thereby ensuring that the user's muscles can be strengthened and rehabilitated. More specifically, the rigid straight bar 102 is configured to transfer a resistive force to the user at a predetermined angle during one or more of the exercise activities. The fastening mechanism 104 may alternatively include an O-ring, a D-ring, a U-bolt or any other suitable attachment means.

The multifunctional leg strengthening device 100 of the present invention combines two separate pieces of exercise equipment, namely a rigid bar or a resistance band (as explained more fully below) and an exercise ball, into a single device thereby eliminating the need for the user to purchase and then store two separate exercise devices. The multifunctional leg strengthening device 100 of the present invention also allows a user to incorporate leg strengthening and balancing movements into the user's workout with a single, easy to use device. The multifunctional leg strengthening device 100 may be used at a gym, office or at home, and may be stored, for example, under a bed or in a closet due to its relatively compact configuration. Further, because the exercise ball 106 is attached to the rigid bar 102, the user does not have to worry about dropping or otherwise losing control of the exercise ball and interrupting his or her exercise routine.

In use, the exercise ball 106 can be placed between the legs of the user while being attached to the rigid bar or rod 102. The movement of the exercise ball 106 along with the rigid bar 102, while being grasped by the user, helps to strengthen the muscles of the user's lower body, among others. Additionally, use of the rigid bar 102 requires less strength from the lower body of the user, and the exercise ball 106 can be moved or otherwise repositioned by the user's legs at various angles and directions.

Figure 2:
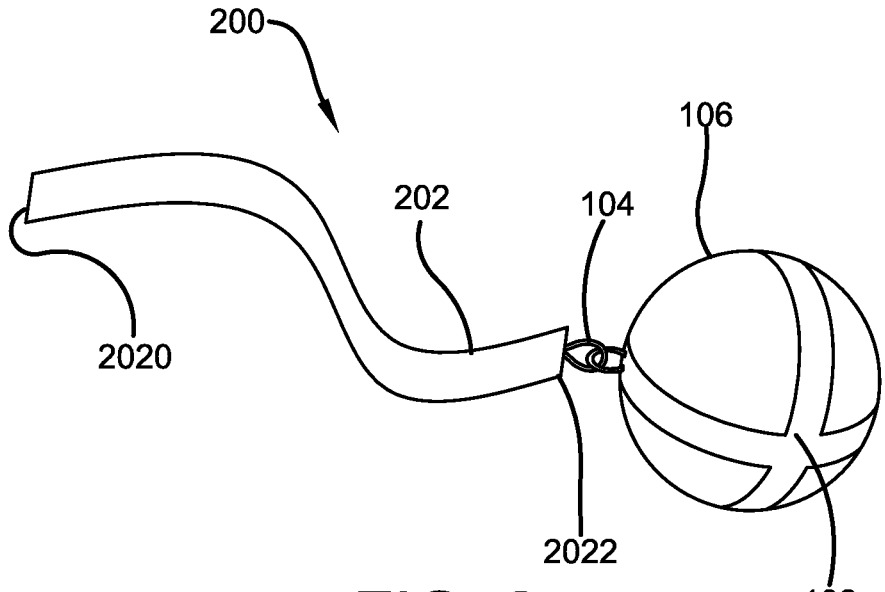
FIG. 2 illustrates a perspective view of one potential embodiment of the multifunctional leg strengthening device of the present invention in accordance with the disclosed architecture and having a resistance band.

FIG. 2 illustrates a perspective view of one potential embodiment of the multifunctional leg strengthening device 200 of the present invention in accordance with the disclosed architecture and having a resistance band 202. More specifically, the flexible multifunctional leg strengthening device 200 is comprised of a relatively flexible resistance band 202 having two opposing ends 2020, 2022, respectively and the exercise ball 106. In use, the user grasps the strengthening device 200 at a first end 2020 of the flexible resistance band 202, and a second end 2022 of the flexible resistance band 202 has a fastening mechanism 104, such as a carabineer clip, that is in turn connected to the exercise ball 106. The flexible resistance band 202 allows the user to move or otherwise reposition the exercise ball 106 with the user's legs into numerous positions.

The flexible resistance band 202 is preferably comprised of a relatively lightweight and stretchable material, such as latex, rubber, Neoprene®, Spandex®, or elastic cotton. The resistance band 202 should be able to withstand several different types of forces without breaking including, without limitation, compression forces, tension forces, torsion forces and shear forces. The flexible resistance band 202 also preferably has a range of expansion of up to 150% of its initial length in an un-extended or relaxed position. The flexible multifunctional leg strengthening device 200 is configurable into a plurality of different positions so that the device 200 can be used for a wide variety of different exercises. One important property or attribute of the flexible resistance band 202 is that the amount of force required to continue to stretch the band increases as the flexible resistance band 202 is stretched. Another important property or attribute of the flexible band 202 is that it does not cause skin irritation or grip fatigue.

Figure 3:
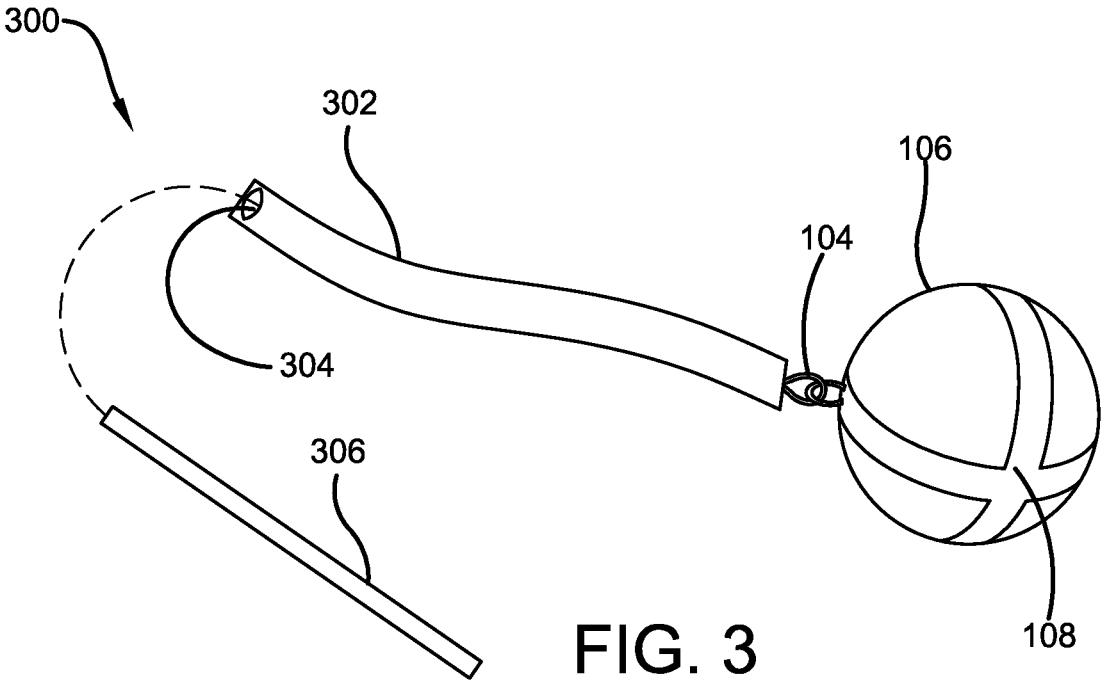
FIG. 3 illustrates a perspective view of one potential embodiment of the multifunctional leg strengthening device of the present invention in accordance with the disclosed architecture and having a resistance band with an opening therein for receipt of a rigid bar.

FIG. 3 illustrates a perspective view of one potential embodiment of the multifunctional leg strengthening device 300 of the present invention in accordance with the disclosed architecture and having a resistance band 302 with an opening 304 therein for receipt of a rigid bar 306. More specifically, the addition of the bar 306 in the flexible band 302 causes the individual user performing the exercise to direct the energy required to pull the band 302 in a single direction, thereby improving the workout of select muscle groups.

Additionally, the current embodiment features an exercise ball 106 that is attached to the resistance band 302 having the pocket 304. The pocket 304 is sized and configured to receive the rigid rod 306 to stiffen the band 302. The rigid stick or rod 306 comes with the pouch based multifunctional leg strengthening fitness equipment 300 of the present embodiment, and is of such a length and width that the rigid stick or rod 306 may be inserted inside the pouch 304 comfortably along substantially the entire length of the band 302. Further, the pouch 304 may have a zipper, hook and loop fastener, or any other suitable fastening or closure mechanism to securely retain the rigid stick or rod 306 within the band 302 and more, specifically pouch 304.

One of the key features of the present invention is that the resistance band 302 is completely flexible, and can be bent and manipulated in various configurations and directions, as well as providing a variable degree of resistance. Nonetheless, the band 302 can also be configured to provide a fixed resistance by inserting rigid stick or rod 306 into pouch 304. The rigid stick or rod 306 design helps accommodate elderly people and those with decreased lower body strength, thereby ensuring that their muscles can be strengthened and rehabilitated as well.

Figure 4A:
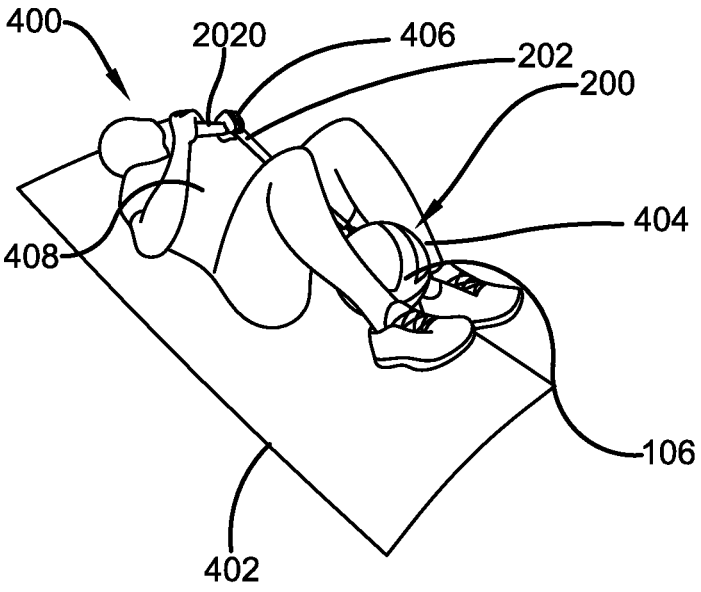
FIG. 4A illustrates a perspective view of a user utilizing one potential embodiment of the multifunctional leg strengthening device of the present invention in accordance with the disclosed architecture to exercise.

FIG. 4A illustrates a perspective view of a user 400 utilizing one potential embodiment of the multifunctional leg strengthening device 200 of the present invention in accordance with the disclosed architecture to exercise. More specifically, in one particular exercise, the user 400 will be positioned in a supine position on top of an exercise mat 402 and using the flexible multifunctional leg strengthening device by grasping a first end 2020 of the resistance band 202 with his or her hand 406 over the torso 408, all while holding the exercise ball 106 between the calves 404 of the user 400 with his or her shoulders and legs on the mat 402.

Importantly, the user will not lose control of the exercise ball 106 as it is removably attached to the band 202 through a fastening mechanism (not shown), thereby enabling the user 400 to perform lower body exercises easily and without any fear of losing control of the exercise ball 106 and/or interrupting the exercise routine. All the embodiments of the multifunctional leg strengthening device 100, 200, 300 can be used in connection with a wide variety of exercises, including, for example, any type of exercise relating to strength training, core conditioning, stability and stretching. Countless exercises can be performed with the multifunctional leg strengthening fitness device 100, 200, 300 of the present invention.

In some embodiments, the resistance band 202 is adjustably connected to an exercise board, such that the resistance band 202 interfaces with the user 400 at a predetermined position. In one embodiment, the resistance band 202 may have a grip wrap around the gripping section of the resistance band 202, wherein the grip wrap rotates to prevent the user 400 from obtaining any leveraged advantage in stretching the band 202.

The resistance band or rigid bar of the present invention may have a length (measured between the first and second ends) in the range of three to seven feet, a width of four to five inches, and a thickness of approximately $1/8^{th}$ of an inch. Alternatively, the resistance band or rigid bar may have a width of between three to six inches and a thickness of approximately $1/10^{th}$ of an inch. Generally stated, the wider and/or thicker the resistance band, the more tension or resistance the same provides to the user. Further, the band and the rod are preferably substantially the same length, and the elastic nature of the band allows the full length of the rod to be inserted into the band.

The band 202 may be formed of natural latex rubber for increased strength and resiliency, or a comparable synthetic rubber, or other material having elastic properties, such as Neoprene®, Spandex® or elastic cotton. Alternatively, the resistance band 202 of the present invention may be any type of cord, or other flexible material. Some exemplary materials of such include, but are not limited to, bungee cords, flexible rubber straps, nylon, vinyl, latex, viscoelastic material, or other types of elastic, flexible, or stretchy cords. The stick or rod used in the rigid embodiments of the present invention may be made of any type of suitable material, such as metal, plastic, or other rigid materials.

As described herein, the multifunctional leg strengthening device of the present invention may be available in a plurality of different embodiments in accordance with the preferences of the user. For example, in one embodiment, the multifunctional leg strengthening device has of a rigid stick attached to the exercise ball. In another embodiment, the multifunctional leg strengthening device features a pouch or pocket in the resistance band, which is removably attached to the exercise ball. In yet another embodiment, the multifunctional leg strengthening device features a flexible resistance band removably attached to the exercise ball. The multifunctional leg strengthening device may be made commercially available in any of the above versions, such as fixed or rigid equipment design. Alternatively, the multifunctional leg strengthening device may be marketed as a package of all three versions so that the user can select the appropriate embodiment for a particular application. Further, the exercise ball can be detached from the leg strengthening strap or rod as and when required by the user. The user may also attach a kettlebell to the resistance band/rod through the attachment means, such as a hook or carabineer clip, for strengthening of lower body.

Figure 4B:
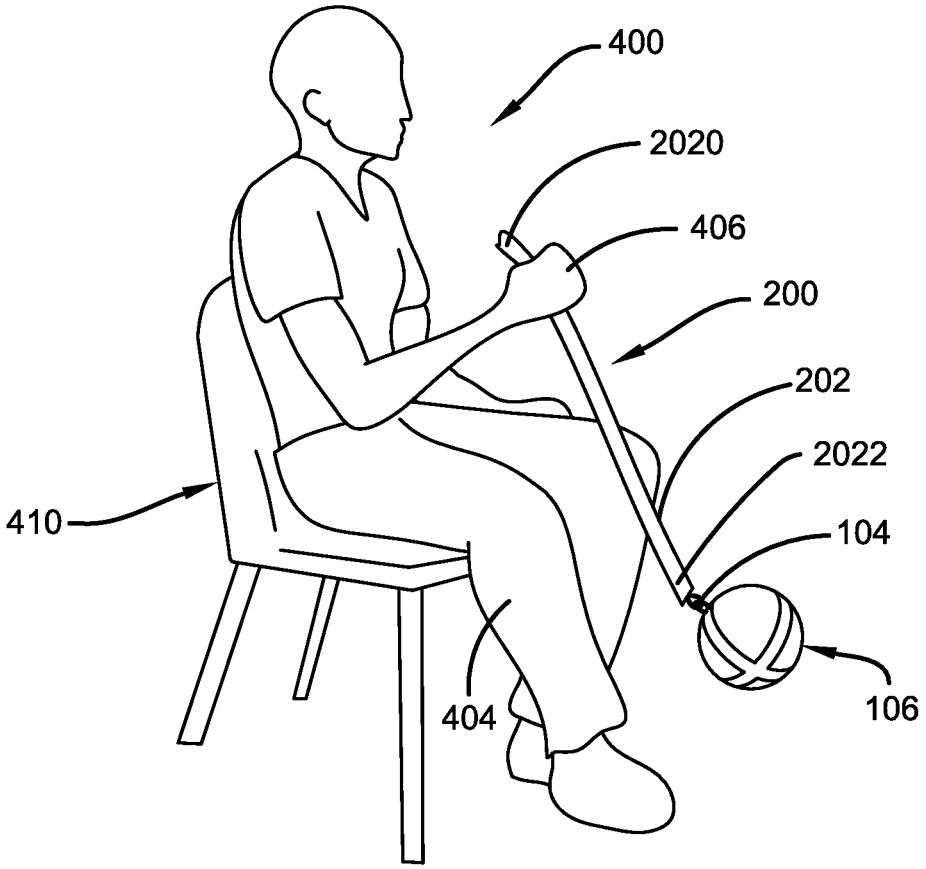
FIG. 4B illustrates a perspective view of a user in a chair utilizing one potential embodiment of the multifunctional leg strengthening device of the present invention in accordance with the disclosed architecture to exercise.

FIG. 4B illustrates a perspective view of a user 400 in a chair utilizing one potential embodiment of the multifunctional leg strengthening device 200 of the present invention in accordance with the disclosed architecture to exercise. For example, the user 400 may be in a seated position, such as on a chair 410, bed, couch or the like, and may kick the ball in a forward, backward or sideways direction relative to the user. Nonetheless, the invention is not so limited and the user may kick the ball in any direction.

Figure 5:
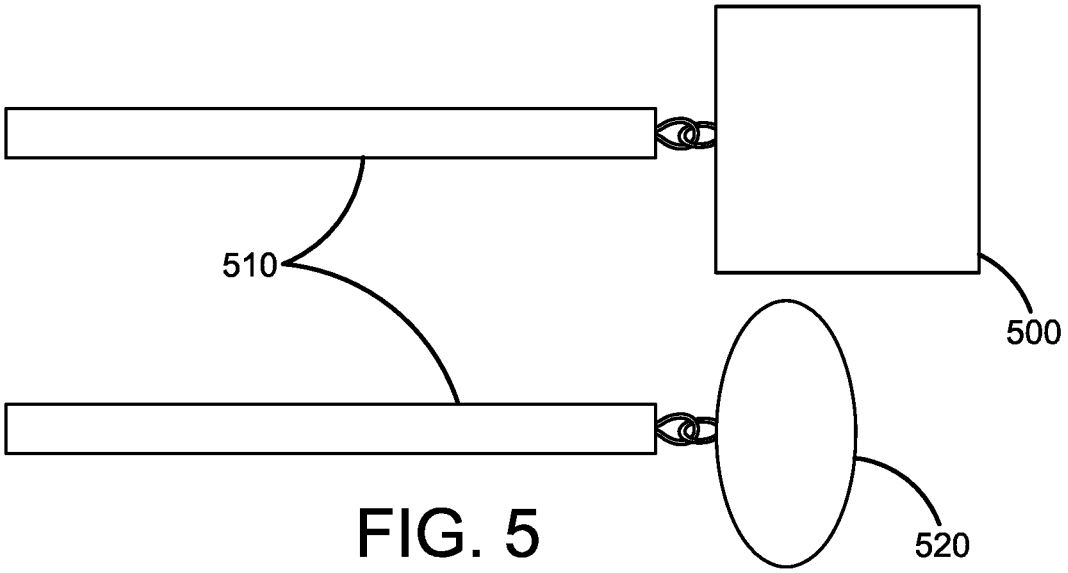
FIG. 5 illustrates a perspective view of two alternatives of potential embodiments of the multifunctional leg strengthening device of the present invention in accordance with the disclosed architecture, wherein the shape of the exercise ball is not spherical.

FIG. 5 illustrates a perspective view of two alternatives of potential embodiments of the multifunctional leg strengthening device of the present invention in accordance with the disclosed architecture, wherein the shape of the exercise ball is not spherical. For example, FIG. 5 illustrates a square geometric shape 500 removably attached to a flexible band 510, as well as an elongated member 520, attached to a flexible band 510. The square 500 and elongated element 520 may each be held by the legs of the individual performing an exercise, and used to achieve similar lower body conditioning.

All the possible embodiments of the multifunctional leg strengthening fitness of the present invention can be used to stretch and strengthen muscles, tendons, joints, ligaments of posterior, anterior, medial and interior lower extremities of the legs and other body parts that have become tight such as calves, muscles of the legs and arms as well tendons and ligaments in the arms and legs. The multifunctional leg strengthening device 100, 200, 300 of the present invention is relatively compact, lightweight and highly portable, and may be used in many different venues including, but not limited to, hospitals, nursing homes, rehabilitation venues, clinics, gyms, home, office, etc.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "leg strengthening device", "leg strengthening equipment", "multifunctional leg strengthening device", "rigid multifunctional leg strengthening device" and "flexible multifunctional leg strengthening device" are interchangeable and refer to the multifunctional leg strengthening device 100, 200, 300 of the present invention.

Notwithstanding the forgoing, the multifunctional leg strengthening device 100, 200, 300 of the present invention and its various components can be of any suitable size and configuration as is known in the art without affecting the overall concept of the invention, provided that they accomplish the above stated objectives. One of ordinary skill in the art will appreciate that the size, configuration and material of the multifunctional leg strengthening device 100, 200, 300 and their various components, as shown in the FIGS., are for illustrative purposes only, and that many other sizes and shapes of the multifunctional leg strengthening device 100, 200, 300 are well within the scope of the present disclosure. Although the dimensions of the multifunctional leg strengthening device 100, 200, 300 are important design parameters for user convenience, the multifunctional leg strengthening device 100, 200, 300 and it's various components may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An exercise device comprising:
- a band having a first end and a second end;
- a ball connected to the second end; and
- a grip positioned on the first end of the band, wherein the band is extendable between a relaxed position and an extendable position;
- wherein the band has a length that varies between the relaxed position and the extendable position; and
- further wherein the band has a pocket extending substantially along the length of the band.

2. The exercise device as recited in claim 1, further comprising a rigid rod inserted in the pocket.

3. The exercise device as recited in claim 2, wherein a length of the rigid rod is less than the length of the band.

4. A personal strengthening device comprising:
- a geometric element;
- a flexible band having a first end and a second end, wherein the geometric element is removably connected to the first end, wherein the flexible band is comprised of a pocket which extends substantially along a length of the flexible band;
- a handle portion provided at the second end of the flexible band; and
- a rod.

5. The personal strengthening device as recited in claim 4, wherein the rod fits within the pocket.

6. A leg strengthening device comprising:
- a flexible band having a length and a pocket extending substantially along the length, the flexible band having a first and second end;
- a ball attached to the first end of the flexible band;
- a handle provided on the second end of the flexible band; and
- a rod having a substantially equal length to the length of the flexible band.

7. The leg strengthening device as recited in claim 6, wherein the ball is removably attached to the first end by a fastener.

8. The leg strengthening device as recited in claim 6, wherein the rod is inserted into the pocket of the flexible band.

* * * * *